US005954001A

United States Patent [19]

Morin

[11] Patent Number: 5,954,001

[45] Date of Patent: Sep. 21, 1999

[54] FLUIDIZED BED REACTOR FOR HEAT TREATMENT OF WASTE

[75] Inventor: Jean-Xavier Morin, Neuville Aux Bois, France

[73] Assignee: GEC Alsthom Stein Industrie, Velizy-Villacoublay, France

[21] Appl. No.: 08/776,310

[22] PCT Filed: Jun. 5, 1996

[86] PCT No.: PCT/FR96/00844

§ 371 Date: Jan. 29, 1997

§ 102(e) Date: Jan. 29, 1997

[87] PCT Pub. No.: WO96/40837

PCT Pub. Date: Dec. 19, 1996

[30] Foreign Application Priority Data

Jun. 7, 1995 [FR] France ..... 95 06707

[51] Int. Cl.[6] ..... F23G 5/00; F23B 5/00; F23B 5/02; F23J 3/00

[52] U.S. Cl. ..... 110/245; 110/204; 110/210; 110/214; 110/216; 110/251; 110/255; 431/170; 165/104.16

[58] Field of Search ..... 110/245, 251, 110/255, 235, 203, 204, 210, 214, 216; 122/4 D; 431/159, 170; 165/104.15, 104.16, 104.18

[56] References Cited

U.S. PATENT DOCUMENTS

| | | | |
|---|---|---|---|
| 4,165,717 | 8/1979 | Reh et al. | 122/4 D |
| 4,335,662 | 6/1982 | Jones | 110/263 |
| 4,992,245 | 2/1991 | Van Slooten et al. | 422/146 |
| 5,091,156 | 2/1992 | Ijas et al. | 422/146 |
| 5,316,736 | 5/1994 | Vidal et al. | 422/145 |
| 5,325,823 | 7/1994 | Garcia-Mallol | 122/4 D |
| 5,453,251 | 9/1995 | Vidal et al. . | |
| 5,505,907 | 4/1996 | Hiltunen et al. | 422/146 |
| 5,508,007 | 4/1996 | Vidal et al. . | |

FOREIGN PATENT DOCUMENTS

| | | | |
|---|---|---|---|
| 0453373A1 | 10/1991 | European Pat. Off. . | |
| 90 05 060 | 4/1990 | France . | |
| 92 05 165 | 4/1992 | France . | |
| 3322971A1 | 1/1985 | Germany . | |
| 3721341C1 | 11/1988 | Germany . | |
| 2070960A | 9/1981 | United Kingdom . | |
| 82/01055 | 4/1982 | WIPO | 110/245 |

*Primary Examiner*—Ira S. Lazarus
*Assistant Examiner*—Ljiljana V. Ciric
*Attorney, Agent, or Firm*—Sughrue, Mion, Zinn, Macpeak & Seas, PLLC

[57] ABSTRACT

A fluidized bed reactor includes an axial recirculating fluidized bed and at least first and second lateral dense fluidized beds, respectively disposed along a first and a second wall of the jacket of the reactor. Waste is fed via at least one point on the first wall of the jacket of the reactor, above the first lateral dense fluidized bed. The reactor includes at least one duct for extracting non-fluidizable heavy elements at the base of the first lateral dense fluidized bed.

18 Claims, 5 Drawing Sheets

FLUIDIZED BED REACTOR FOR HEAT TREATMENT OF WASTE

The present invention relates to the heat treatment of waste. By heat treatment is meant not only the destruction of the waste but also deriving economic benefit through recovery of the greater part of its energy content.

BACKGROUND OF THE INVENTION

One way to treat waste is to carry out heat treatment on it to convert it into an inert material of reduced volume compared to its original volume, during which treatment, the waste gives up a great part of its energy content in the form of heat energy exchanged with an energy recovery unit, for example.

DESCRIPTION OF RELATED ART

A problem that is frequently encountered in the treatment of waste is the necessity to sort it beforehand, to separate the combustible materials from the other materials and to break the latter waste down into very small fragments to facilitate the treatment. The prior art grid type devices cannot always treat any type of waste, and in particular they offer only a limited possibility of treating sludge from settling tanks of waste water purification installations.

One major problem encountered in the treatment of waste is the presence in the waste of substances which release chlorine when decomposed by heat, the chlorine very quickly causing corrosion damage of the heat exchanger tubes of the energy recovery unit heaters.

SUMMARY OF THE PRESENT INVENTION

One aim of the present invention is to define a reactor able to receive all types of waste, including settling tank sludge, requiring no preliminary sorting and requiring only coarse chopping of the waste.

Another aim of the present invention is to define a reactor in which the heat exchange area, for example the area of heat exchange with the heat exchanger tubes of the superheaters of an energy recovery unit, is free of chlorine.

These aims are achieved in a fluidized bed reactor derived from that described in U.S. Pat. Nos. 5,508,007 and 5,316,736, and its continuation U.S. Pat. No. 5,453,251 and hereby incorporated by way of reference into the present application.

The invention consists in a fluidized bed reactor for heat treatment of waste and heat exchange between recirculating solids and a heat exchanger unit, such as a steam generator and/or a superheater, the reactor being of the type including an axial recirculating fluidized bed and at least first and second lateral dense fluidized beds respectively along a first wall and a second wall of the jacket of the reactor, characterized in that the waste is fed via at least one point on said first wall above the first lateral dense fluidized bed, the reactor further comprising at least one duct for extracting non-fluidizable heavy elements at the base of the first fluidized bed.

The heat exchange is preferably effected in the second lateral dense fluidized bed.

The duct for extracting the heavy elements has an inclined part extending an inclined hearth of the first lateral dense fluidized bed, and air blower nozzles directing a variable direction flow being flush with the surface of said hearth.

The extraction duct is provided with adjustable air injector means for varying the flowrate of the solids in the duct.

The base of the second dense fluidized bed is connected by at least one extractor duct to the base of the recirculating fluidized bed.

The extractor duct is provided with adjustable air injector means for varying the flowrate of the solids in the duct.

The recirculating fluidized bed and the first dense lateral fluidized bed are fluidized by a mixture of primary air and recycled smoke.

The second dense lateral fluidized bed is fluidized by a mixture of air and dechlorinated recycled smoke.

Tertiary air is fed through each of the reactor walls by variable flowrate injector means at a height above that of the points at which the waste is introduced.

At least the tertiary air injected into the wall at which is located the heat exchange dense fluidized bed is mixed with recycled and dechlorinated smoke.

The base of the reactor includes means for extracting inert material.

The duct for extracting non-fluidizable heavy elements is associated with a device for sorting and extracting the inert elements.

The reactor includes a third lateral fluidized bed, heat being exchanged through at least one of the second and third lateral fluidized beds.

The reactor comprises third and fourth lateral fluidized beds, heat being exchanged with at least one of second, third and fourth lateral fluidized beds.

The reactor includes means for feeding the waste feed fluidized bed with some of the materials from at least one heat exchange bed.

The reactor is connected to a hot cyclone via the wall opposite the wall through which the waste is fed.

The walls of the reactor include heat exchanger tubes.

The reactor includes an auxiliary fluidized bed containing a heat exchanger unit fed with some of the solids from the second dense fluidized bed, provided with fluidization means, at least one duct for returning solids to the bottom of the recirculating fluidized bed and a vent for directing gases to the top of the recirculating fluidized bed.

The reactor is fed with waste that comprises a mixture of domestic waste and/or waste selected from settling tank sludge, biomass residues, industrial waste and grinding residues and/or fossil fuels selected from coal and oil residues.

BRIEF DESCRIPTION OF THE DRAWINGS

The invention is explained by the following description of one embodiment with reference to the appended drawings, in which.

DESCRIPTION OF THE PREFERRED EMBODIMENTS

Figure 1:
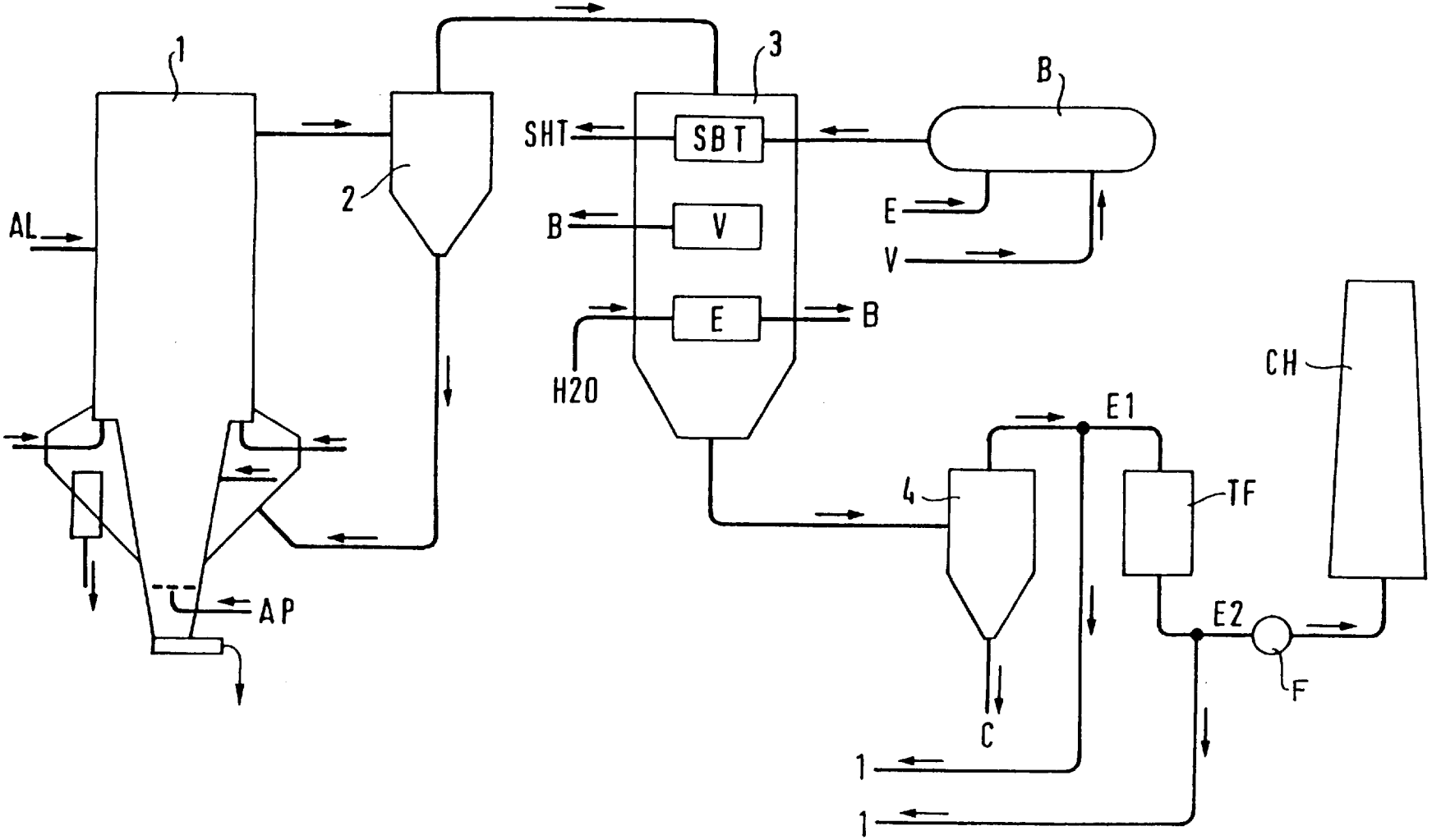
FIG. 1 is a diagrammatic view of part of the thermal installations of a waste treatment unit.

FIG. 1 is a simplified diagrammatic representation of part of the thermal installations of a waste treatment unit in accordance with the present invention. The steam turbine and the electrical power generator are not shown.

FIG. 1 includes a fluidized bed reactor 1, the subject matter of the present patent application, fed with products to be treated. The top part of this reactor is connected to the top part of a hot cyclone 2 in which the gases are separated from most of the solid materials with which they are charged, the latter returning to the reactor.

The hot gases from the outlet of the hot cyclone 2 are fed into a heat exchanger unit 3 including, for example:

- a low-temperature superheater heat exchanger SBT receiving steam from a boiler tank B and feeding superheated steam to the high-temperature superheater heat exchanger SHT in the reactor,
- a steam generator V feeding steam to the boiler tank B,
- an economizer E receiving the feed water and feeding it to the boiler tank B.

The gases leaving the heat exchanger unit 3 are fed to a gas-solid separator 4 in which the gases are separated for the coarse fraction C of the fly ash that is collected at the base of the cyclone 4.

The gases separated in this way from said fraction are fed to a smoke treatment unit TF from which they are extracted by a draw-off fan F and fed to the base of a chimney CH.

Figure 2:
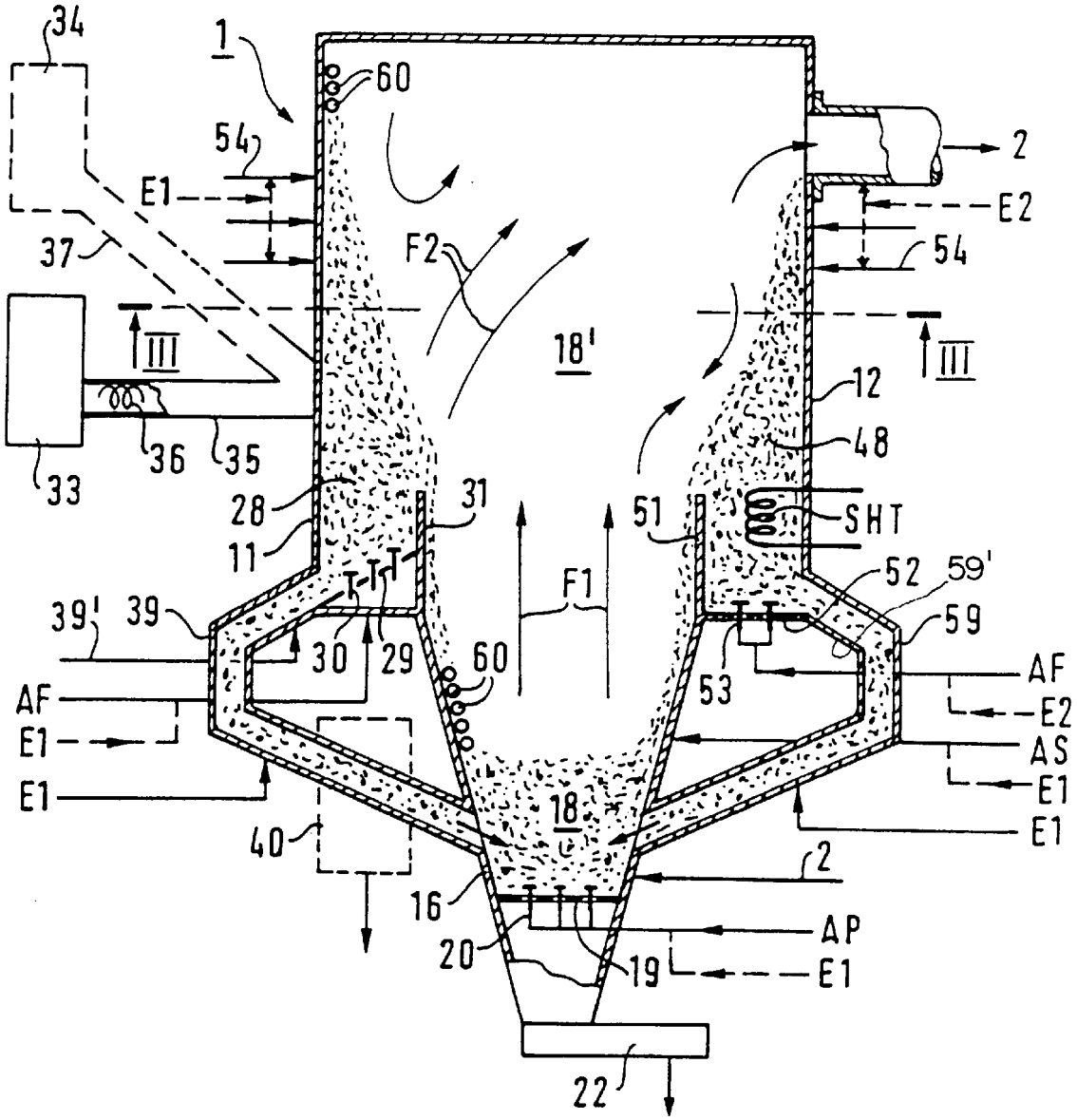
FIG. 2 is a diagrammatic view in elevation of a reactor that is part of the installation.
Figure 3:
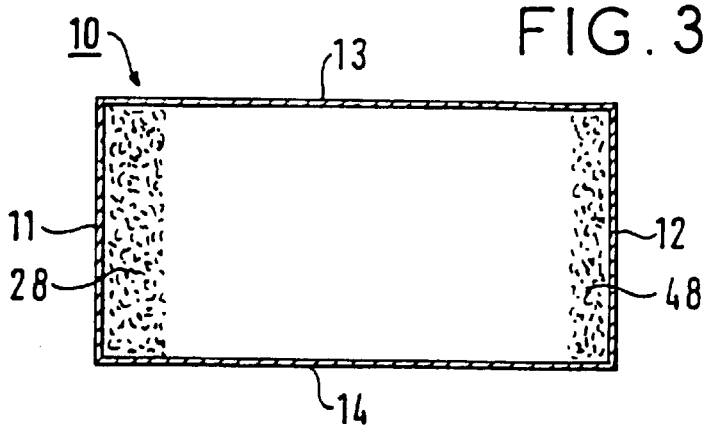
FIG. 3 is a view in section on the line III—III in FIG. 2.

The reactor 1, which constitutes the subject matter of the present invention, is shown in more detail in FIGS. 2 and 3.

The non-limiting example described is that of a reactor with two lateral dense fluidized beds.

The reactor 1 has a jacket 10 that can be rectangular in cross-section and therefore has four walls 11, 12, 13 and 14.

The lower part 16 of the reactor 1 is a truncated inverted pyramid, an inverted pseudo-pyramid with two parallel faces or a truncated cone; in this part is installed an axial recirculating fluidized bed comprising a lower part 18 surmounted by an upper part 18', as explained above. The lower part 18 of the recirculating fluidized bed is fed with pyrolized fuel obtained in particular from overflow from the lateral dense bed 28 (see below). A grid 19 at the base of the part 18 of the bed is provided with nozzles 20 for injecting primary air, shown in the drawing by the arrow AP, optionally mixed with smoke taken from the input E1 of the smoke treatment unit TF.

Above the grid 19 are secondary air inlets AS, also with the option of mixing with smoke taken from the input E1 of the smoke treatment unit TF.

Means for preheating the reactor, not shown, located above the grid 19 are used to heat the reactor from a cold or warm state to the temperature needed to burn the waste.

Under the grid 19 is a residue extractor device 22 such as a cooled screw extractor or a dry extractor.

In the example shown in FIGS. 2 and 3 the reactor comprises two lateral dense fluidized beds 28 and 48.

The lateral fluidized bed 28 against the wall 11 includes a hearth 29 that is preferably inclined and which incorporates directional blower nozzles 30 so that the direction of the blown flow can be varied between a direction perpendicular to the plane of the hearth and a direction parallel to that plane. The nozzles are fed with air (AF), optionally mixed with recycled smoke from the point E1. The dense fluidized bed 28 is partially contained by a high overflow wall 31 at the end of the hearth 29 parallel to the wall 11.

The dense fluidized bed 28 is fed with the waste to be treated which, in accordance with a fundamental feature of the invention, is injected into the dense fluidized bed at various points along the wall 11, preferably at a height greater than that of the top of the overflow wall 31.

The waste is fed via shears 33 or 34 which coarsely chop the waste to a maximal size between 200 mm and 400 mm.

The chopped waste is fed into the duct 37 either by gravity alone or via ducts 35 provided with injector screws such as the screw 36. Conventional means that are not shown control the flowrate at which the waste is introduced.

A duct 39 (or several such ducts if necessary) extending the hearth 29 collect(s) heavy elements that cannot be fluidized such as scrap metal, bottles, broken glass, etc, or elements that have not been pyrolized. These elements are fed to the base of the part 18 of the recirculating fluidized bed, optionally passing beforehand through a sorting device 40 from which the elements are extracted so that they do not disturb the fluidization at the base of the recirculating fluidized bed 18.

Recycled smoke can be injected into the ducts 39, from the point E1 on the input side of the smoke treatment unit TF, for example.

The ducts 39 are provided near the grid 19 with means for adjusting the flowrate of the solids passing through the ducts. These means may be in the form of adjustable air inlets 39'.

The wall 11 through which the waste is introduced is protected by a coating of silicon carbide or any other material resistant to the reducing environment; the benefit of this coating is explained below.

In accordance with the invention, a second lateral dense fluidized bed 48 is installed along the wall 12 which, in the example described, is the wall opposite the wall 11. It includes an overflow wall 51, a grid 52 and blower nozzles 53 fed with air (AF), optionally mixed with dechlorinated recycled smoke from a point E2 on the output side of the smoke treatment unit TF, for example.

The base of the dense bed 48 is connected by ducts 59 to the lower part 18 of the recirculating fluidized bed.

Means are provided for adjusting the flowrate of the solids in the ducts 59; these means can be in the form of variable flowrate air inlets 59'.

The heat exchanger unit SHT is disposed in this bed 48. It may comprise steam generators and/or high-temperature steam superheaters.

The reactor is completed by tertiary air injectors 54 on the four faces of the reactor at a height above that of the lateral dense fluidized beds. Once again, the tertiary air may be mixed with recycled smoke from the point E1 in the case of the injectors in the feed dense bed 28 and dechlorinated smoke from the point E2 in the case of the exchange dense bed 48.

As explained in the documents previously cited, the temperature at the center of the reactor is in excess of 850° C., usually between 850° C. and 950° C. to comply with regulations concerning the combustion of waste.

The ratio of the cross-section area S2 above the overflow walls 31 and 51 to the cross-section area S1 between these overflow walls is between 1.05 and 2.

The "when empty" speed of the fluidizing gas in the lower axial part 18 (upwards arrows F1) is between 3 m/s and 12 m/s.

The "when empty" surface speed of the fluidizing gases in the lateral dense bed is between 0.3 m/s and 2.5 m/s.

When the ratio S2/S1 has been fixed, the values of the above speeds and the temperatures can be adjusted by varying the following parameters:

- the flowrate at which the waste is introduced,
- the primary, secondary and tertiary air flowrates,
- the particle size of the recirculating bed material,
- the percentage of the reactor filled with solids.

The operation of the reactor is as follows.

The coarsely chopped waste is introduced into the reactor 1. On the sudden contact of the descending layer of solids with the wall 11, which is at a temperature in excess of 850° C. (usually between 870° C. and 900° C.), the chlorine contained in the waste is immediately released by flash pyrolysis (instantaneous pyrolysis) and almost all of this gas is drawn into the top of the reactor (arrows F2) and thence into the hot cyclone 2. The silicon carbide coating protecting the wall 11 through which the waste is fed protects the latter against the corrosive effect of the hot chlorine in combination with reducing gases (mainly CO).

This pyrolysis effect is obtained by mixing the waste introduced and a descending wall of solids in the form of a dense layer due to the upper part 18' operating as a recirculating fluidized bed.

The dense fluidized bed 48 is fed by the dense layer of recirculating solids due to the operation of the recirculating fluidized bed 18–18'. The dense bed 48 is fluidized by a mixture of air and dechlorinated smoke, as mentioned above. The bed 48 is therefore free of chlorine-containing products. The heat exchanger unit SHT can therefore be accommodated in it; this unit is placed in an environment at which the temperature is approximately 870° C. so that superheated steam is obtained at 450° C. or 500° C. (rather than 360° C. as in the prior art reactors because the exchanger cannot be placed in an environment at a temperature exceeding 600° C. without very rapid corrosion). This substantial increase in the temperature of the superheated steam, which is used in a turbine, not shown, increases the efficiency of the Carnot cycle of the installation, and therefore the economic benefit of recovering energy from the waste, and increases the service life of the exchangers SHT, commensurately increasing the availability of the installation.

It is possible to use heat exchanger units having external heat exchange coefficients of 450 $W/m^2K$ (rather than 35 $W/m^2K$ in the prior art) and a much higher mean logarithmic temperature difference (450° C. rather than 250° C.).

Finally, there is no risk of soiling of the heat exchanger unit; in the conventional art this risk leads to virtual doubling of the heat exchange surface area and the installation of costly sweeper systems.

The use of this type of heat exchanger unit leads to a substantial reduction in size and therefore in cost.

The fluidized reactor can operate with an overall excess of air compared to stoichiometric conditions, limited to a ratio of 1.4, which has the two-fold advantage of complying with the regulations and of being more economical than some installations which require an excess air ratio of 1.8 or 1.9.

By their very nature, recirculating fluidized beds lead to low nitrogen oxide levels because of the low temperature, the staged air feed and the low air flowrate; if necessary, ammonia can be injected on the input side of the hot cyclone 2. In this way the upper limit of 200 $mg/m^3$ can easily be complied with.

The variable injection of tertiary air at the four faces 11 through 14, as shown in the drawing by the arrows 54, provides auxiliary air for combustion of the volatile combustible materials released by the flash pyrolysis. This air enables rapid mixing of the gases in the upper part of the reactor, which favors the evacuation of the chlorine. A final injection of air may be effected on the input side of the cyclone 2.

The wall through which the reactor 1 is coupled to the cyclone 2, which is the wall 12 in this example, is preferably opposite the wall 11 through which the reactor is fed with the waste.

The invention also applies to the simultaneous treatment of waste augmented with a certain proportion of sludge from waste water purification stations, biomass residues, ordinary industrial waste and ground automobile recycling residues.

The invention also applies to the simultaneous treatment of waste with fossil fuels of the coal or oil residue type. The latter are introduced into the bottom of the lower area 18 of the recirculating fluidized bed 18–18', for example via the return duct of the cyclone 2.

The reactor may include means for injecting agents for fixing the sulfur contained in the smoke, such as limestone.

If the temperature of the dense bed through which the waste is introduced is required to be lower than 870° C. to 900° C. for some reason, it is possible to feed the dense bed 28 through which the waste is introduced with some of the products from the heat exchange bed 48.

The walls of the reactor can be completely or partly covered with tubes. The tubes 60, only some of which are shown, carry a mixture of water and steam from and to the boiler tank.

The invention is not limited to the embodiment described and shown.

In particular, the reactor may include a third lateral dense fluidized bed, heat being exchanged with at least one of the second and third lateral dense fluidized beds.

Figure 5:
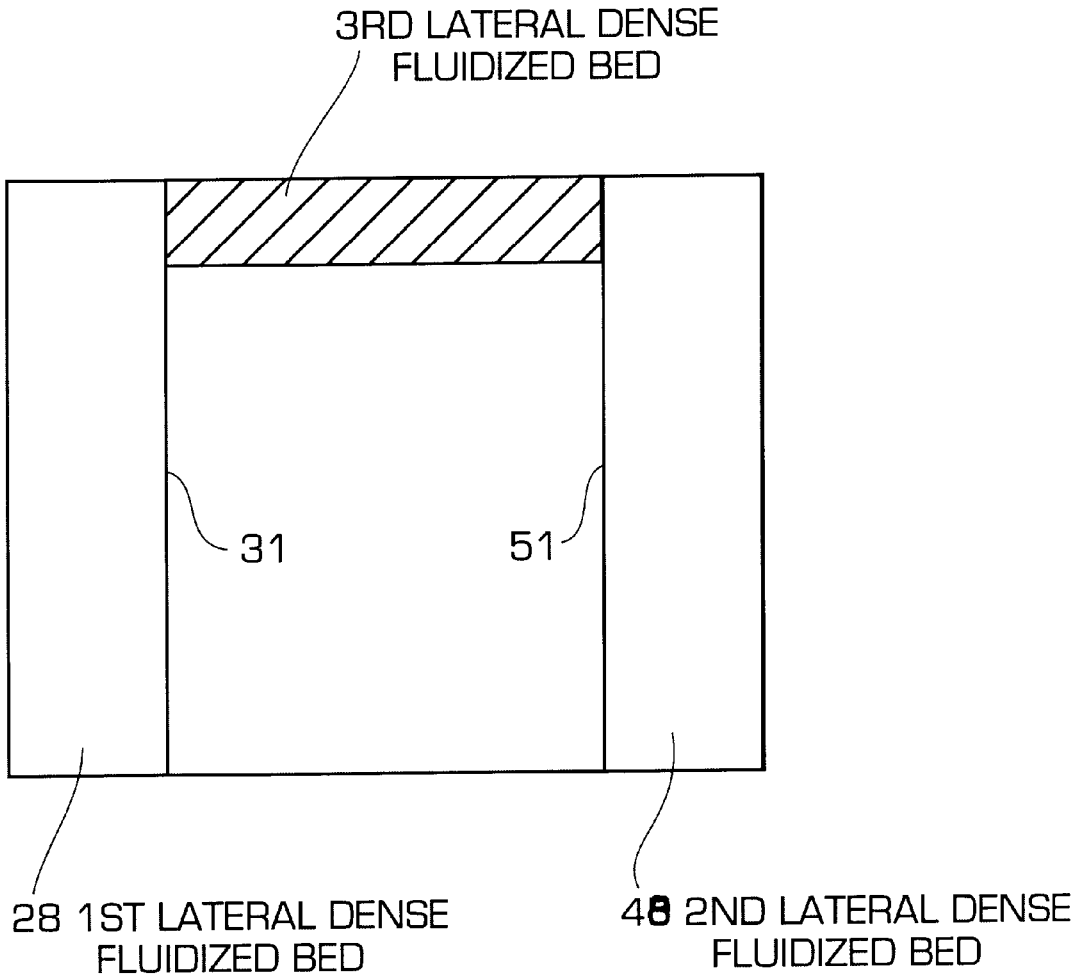
FIG. 5 is a diagrammatic view of the reactor including a third lateral fluidized bed.
Figure 6:
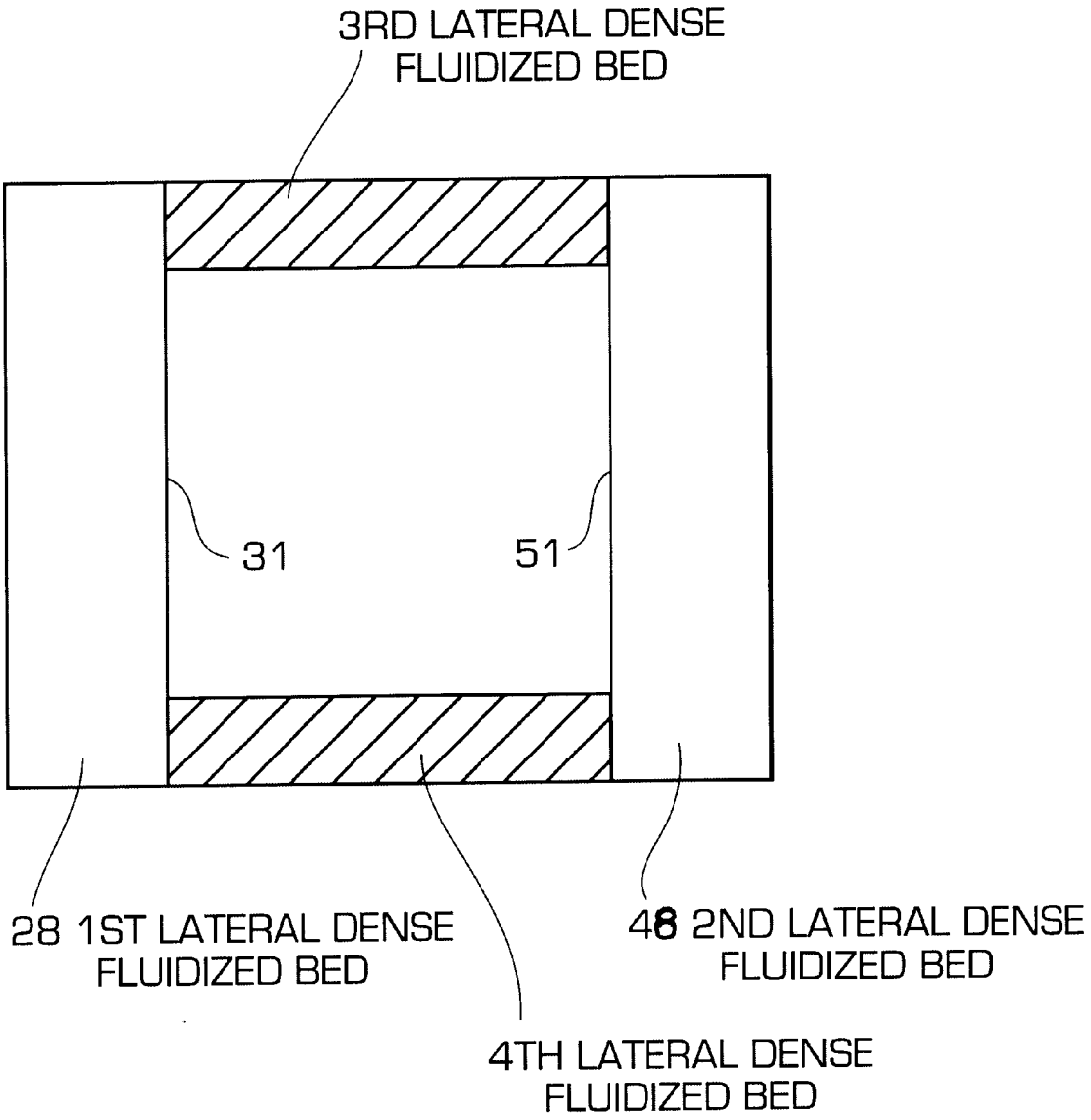
FIG. 6 is a diagrammatic view of the reactor including third and fourth lateral fluidized beds.

Another embodiment of the reactor in accordance with the invention includes third and fourth lateral fluidized beds (see FIGS. 5 and 6), heat being exchanged with at least one of the second, third and fourth lateral fluidized beds.

In both embodiments the waste feed dense bed may be fed by one or more of the other dense beds.

Figure 4:
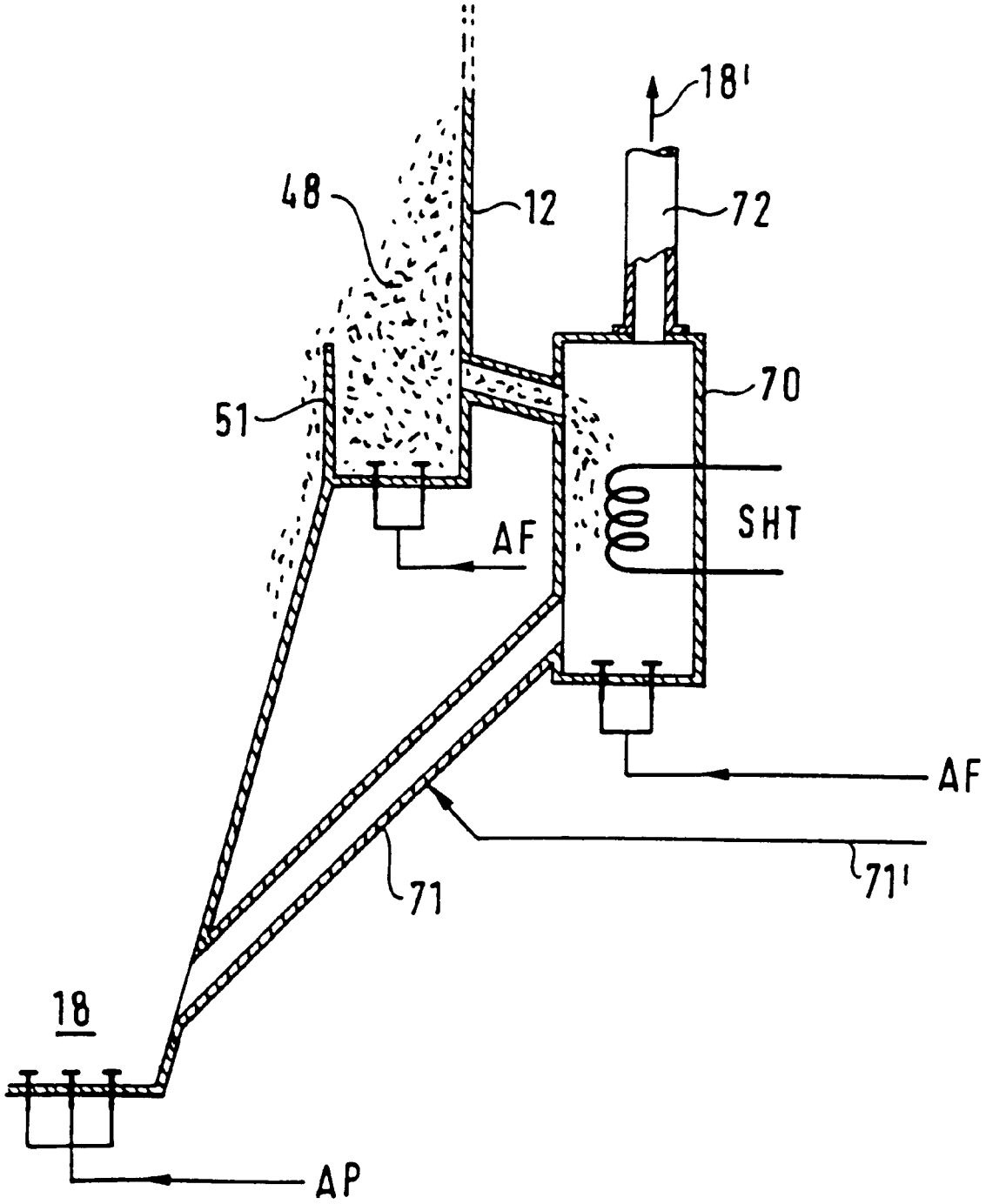
FIG. 4 is a diagrammatic view of part of an alternative embodiment of the reactor.

FIG. 4 shows an embodiment in which solids recovered by the dense bed 48 are transferred into an auxiliary fluidized bed exchanger 70 before they are re-injected into the area 18 via ducts 71 provided with flowrate regulating air feed means 71'. The heat exchanger unit SHT is disposed in this bed 70.

The gases fluidizing the bed 70 are re-injected via a duct 72 into the upper part 18' of the bed 18–18'.

This embodiment dissociates size constraints associated with the hydrodynamic requirements of the gas-solid flow from the requirement to respect the thermal balance of the installation, possibly necessitating large exchangers.

What is claimed is:

1. A fluidized bed reactor for heat treatment of waste and heat exchange between recirculating solids and a heat exchanger unit, the reactor comprising:

a jacket having a plurality of walls;

an axial recirculating fluidized bed;

a first lateral dense fluidized bed; and a second lateral dense fluidized bed, said first lateral dense fluidized bed and said second lateral dense fluidized bed being disposed along a first wall and a second wall of the plurality of walls of the jacket of the reactor;

wherein waste is fed via at least one point on said first wall above said first lateral dense fluidized bed;

said reactor further comprising:

at least one first extractor duct for extracting non-fluidizable heavy elements at a base of said first lateral dense fluidized bed;

wherein the duct for extracting the heavy elements has a inclined part extending an inclined hearth of said first lateral dense fluidized bed; and air blower nozzles directing a variable direction flow and being flush with the surface of said hearth.

2. The reactor according to claim 1, wherein the heat exchange is effected in said second lateral dense fluidized bed.

3. The reactor according to claim 1, wherein said first extractor duct is provided with first means for adjusting and injecting air, said first adjustable air injector means for varying a flowrate of the solids in said first extractor duct.

4. The reactor according to claim 1, wherein a base of said second dense fluidized bed is connected by at least one second extractor duct to a base of said recirculating fluidized bed.

5. The reactor according to claim 4, wherein said second extractor duct is provided with second means for adjusting and injecting air, said second adjustable air injector means for varying a flowrate of the solids in said second extractor duct.

6. The reactor according to claim 1, wherein said recirculating fluidized bed and said first dense lateral fluidized bed into which the waste is introduced, are fluidized by a mixture of primary air and recycled smoke.

7. The reactor according to claim 1, wherein said second dense lateral fluidized bed is fluidized by a mixture of air and dechlorinated recycled smoke.

8. The reactor according to claim 1, further comprising:

means for varying flowrate and injecting air, wherein tertiary air is fed through each of the plurality of walls of said jacket by said variable flowrate injector means at a height above that of the point at which the waste is introduced.

9. The reactor according to claim 8, wherein said heat exchanger unit is disposed in said second lateral dense fluidized bed and located at said second wall, wherein at least said tertiary air injected into said second wall is mixed with recyled and dechlorinated smoke.

10. The reactor according to claim 1, wherein the reactor further comprises a base:

said base of the reactor comprising:

means for extracting inert material.

11. The reactor according to claim 1, wherein said extractor duct for extracting non-fluidizable heavy elements passes the waste through a device for sorting and extracting inert elements.

12. The reactor according to claim 1, wherein the reactor further comprises:

a third lateral dense fluidized bed, heat being exchanged within the reactor with at least one of said second and third lateral dense fluidized beds.

13. The reactor according to claim 1, the reactor further comprising:

third and fourth lateral dense fluidized beds, heat being exchanged within the reactor with at least one of said second, third and fourth lateral dense fluidized beds.

14. The reactor according to claim 1, wherein said reactor further comprises:

means for feeding said second lateral dense fluidized bed with said recirculating solids from at least said axial recirculating fluidized bed.

15. The reactor according to claim 1, wherein the reactor is connected to a hot cyclone via the second wall which is opposite the first wall through which the waste is fed.

16. The reactor according to claim 1, wherein the plurality of walls of the reactor comprise heat exchanger tubes.

17. The reactor according to claim 1, further comprising:

an auxiliary fluidized bed comprising:

a heat exchanger unit fed with a portion of the recirculating solids from the second lateral dense fluidized bed, the reactor further comprising:

means for providing air to said auxiliary fluidized bed, at least one third extractor duct for returning the recirculating solids from said auxiliary fluidized bed to said base of the axial recirculating fluidized bed, and a vent disposed at said auxiliary fluidized bed for directing gases within said auxiliary fluidized bed to a top of the axial recirculating fluidized bed.

18. The reactor according to claim 1, wherein the waste comprises:

a mixture of at least one of domestic waste and waste selected from settling tank sludge, biomass residues, industrial waste and automobile recycling residues and fossil fuels selected from at least one of coal and oil residues.

* * * * *